US011316290B2

(12) United States Patent
Kliever

(10) Patent No.: US 11,316,290 B2
(45) Date of Patent: Apr. 26, 2022

(54) PRINTED CIRCUIT BOARD CONNECTOR

(71) Applicant: HARTING Electric GmbH & Co. KG, Espelkamp (DE)

(72) Inventor: Wilhelm Kliever, Minden (DE)

(73) Assignee: HARTING Electric GmbH & Co. KG, Espelkamp (DE)

( * ) Notice: Subject to any disclaimer, the term of this patent is extended or adjusted under 35 U.S.C. 154(b) by 11 days.

(21) Appl. No.: 16/961,469

(22) PCT Filed: Mar. 5, 2019

(86) PCT No.: PCT/DE2019/100199
§ 371 (c)(1),
(2) Date: Jul. 10, 2020

(87) PCT Pub. No.: WO2019/174671
PCT Pub. Date: Sep. 19, 2019

(65) Prior Publication Data

US 2021/0091488 A1 Mar. 25, 2021

(30) Foreign Application Priority Data

Mar. 13, 2018 (DE) ..... 10 2018 105 784.9

(51) Int. Cl.
*H01R 12/52* (2011.01)
*H01R 12/58* (2011.01)

(52) U.S. Cl.
CPC ..... *H01R 12/523* (2013.01); *H01R 12/585* (2013.01)

(58) Field of Classification Search
CPC .... H01R 12/523; H01R 12/585; H01R 12/00; H01R 12/52; H01R 9/0515; H01R 9/2466; H01R 13/114
See application file for complete search history.

(56) References Cited

U.S. PATENT DOCUMENTS 3,568,001 A * 3/1971 Straus ..... H01R 24/58 361/785
5,059,130 A 10/1991 Miller, Jr.
(Continued)

FOREIGN PATENT DOCUMENTS

DE 102013006923 A1 10/2014
WO 2018006892 A1 1/2018

OTHER PUBLICATIONS

Harting, "DIN-Signal high curr.FS40Afor M-flat". URL: https://b2b.harting.com/ebusiness/de/DIN-Signal-high-curr-FS40A-for-M-flat/09030006225 [retrieved am Oct. 9, 2018].
(Continued)

*Primary Examiner* — Travis S Chambers
(74) *Attorney, Agent, or Firm* — Smartpat PLC

(57) ABSTRACT

A pin-like printed circuit board connector is at least slightly reversibly deformable and has a pin axis. The printed circuit board connector has at least a first slit which starts at the insertion end and runs through the pin axis towards the printed circuit board connection region and by means of which at least two segments pointing in the insertion direction are formed. In particular, the printed circuit board connector can additionally have a second such slit which intersects the first slit in the pin axis, in particular at right angles, forming even four segments pointing in the insertion direction.

22 Claims, 2 Drawing Sheets

(56) References Cited

U.S. PATENT DOCUMENTS

| | | | | |
|---|---|---|---|---|
| 5,427,546 | A * | 6/1995 | Garritano | H01R 11/26 439/502 |
| 5,963,432 | A * | 10/1999 | Crowley | H05K 7/142 174/138 G |
| 6,186,841 | B1 * | 2/2001 | Jacobsson | H01R 13/111 439/851 |
| 6,773,269 | B1 * | 8/2004 | Downes | H05K 3/368 439/55 |
| 6,893,291 | B2 * | 5/2005 | Wendling | H01R 9/0518 439/582 |
| 6,901,646 | B2 * | 6/2005 | Yoon | H05K 7/142 174/138 D |
| 7,025,604 | B2 * | 4/2006 | Frank | H05K 3/368 439/75 |
| 7,114,958 | B2 * | 10/2006 | Angelucci | H01Q 1/1207 439/65 |
| 2014/0315398 | A1 | 10/2014 | Feigl | |
| 2015/0118871 | A1 * | 4/2015 | Yagi | H01R 12/585 439/65 |

OTHER PUBLICATIONS

Harting: Selection Guide für Mezzanine Anwendungen. Edition Mar. 18, 2016 (Version 2). Minden, 2016. S. 5.—Company Publication.

Harting: Steckverbinder DIN 41 612. Edition Mar. 10, 2017 (Version 03 11). Minden, 2017.

* cited by examiner

PRINTED CIRCUIT BOARD CONNECTOR

TECHNICAL FIELD

The disclosure relates to a printed circuit board connector.

BACKGROUND

Printed circuit board connectors are used in order to attach two printed circuit boards to one another and to electrically contact two printed circuit boards to one another, said printed circuit boards being arranged in a desired spacing parallel to one another. In particular, the printed circuit board plug connectors are used to transmit currents of high current strengths between the two printed circuit boards. The term "high current strengths" means in this case and below that it is possible to transmit per printed circuit board connector a current of for example at least 10 amps, in particular at least 16 amps, by way of example at least 24 amps preferably at least 32 amps and in a particularly preferred embodiment even 40 amps and more.

It is known in the prior art by way of example from the publication WO 2018/006892 A1 to electrically and mechanically connect printed circuit boards to one another at their ground contacts by means of screw bolts in order to be able to transmit interference signals on the shortest path to the housing ground. In order to compensate the geometric deviations that unavoidably occur within a predetermined tolerance range during the manufacture of an electrical device as a result of varying housing dimensions, it is proposed to connect these screw bolts to the housing via a plug connection of variable plug-in depth, by way of example via a plug stud bolt.

It is a disadvantage in the case of this prior art that although it is possible in this manner to compensate housing tolerances, it is not possible to compensate the spacings which in this structural shape are predetermined between the individual printed circuit boards as a result of the shape of the screw bolts. However, it has in many cases been demonstrated that during the construction of electrical devices these spacings are also subjected to a certain variation. There is therefore a requirement to provide a mutual mechanical attachment and an electrical contact between the two printed circuit boards mentioned in the introduction. In so doing, it is to ensure in addition a corresponding mechanical tolerance compensation whilst simultaneously transmitting the said high current strengths.

During the priority application regarding the current application, the German Patent and Trademark Office has researched the following prior art: HARTING: DIN-Signal high curr. FS40A for M-flat.; HARTING: Selection Guide für Mezzanine Anwendungen [Selection Guide for Mezzanine Applications], Issue 2016-03-18 (Version 2) and HARTING: Plug connector DIN 41 612. Issue 2017 Mar. 10 (Version 03.11).

SUMMARY

The object of the disclosure is to provide a printed circuit board connector that on the one hand is able to transmit high current strengths between two printed circuit boards that are arranged parallel to one another, and that on the other hand is suitable for mechanically attaching the two printed circuit boards to one another, wherein their spacing may vary within a predetermined tolerance range.

In this case and below, the term "high current strengths" means in particular that it is possible to transmit per printed circuit board connector a current of for example at least 10 amps, in particular at least 16 amps, by way of example at least 24 amps preferably at least 32 amps and in a particularly preferred embodiment even 40 amps and more.

This object is achieved by means of the features of the independent claims.

A printed circuit board connector is configured as a contact pin with a pin axis and comprises a printed circuit board connection region at its connection-side end. Lying opposite, it comprises on an end section of its mating-side end a mating region that tapers toward the mating-side end. The printed circuit board connector comprises a connection section between the printed circuit board connection region and the mating region.

The printed circuit board connector comprises furthermore at least a first slit that commences at the mating-side end and extends through a pin axis in the direction of printed circuit board connection region.

The printed circuit board connector may comprise a symmetry at least in regions and may be configured at least in one region in a rotationally symmetrical and/or mirror symmetrical, in particular axial symmetrical, manner.

It is preferred that the pin axis may be a symmetrical axis of the printed circuit board or at least a section of the printed circuit board.

Advantageous embodiments of the invention are disclosed in the dependent claims.

Advantageously, the printed circuit board may protrude with its printed circuit board connection region through a first through-going contact opening of a first printed circuit board and in so doing contact in an electrically conductive manner a first contact region that is arranged on—and in particular also in—the through-going contact opening.

It is of particular advantage that in the printed circuit board at least two in particular identical segments of the printed circuit board connector that are free-standing in the mating direction are formed by means of the said at least one slit in its connection region and in the mating region. These at least two segments each face in the direction of the mating-side end and may be moved with their free-standing ends at least slightly toward one another as a result of an at least slight elastic deformation of the printed circuit board connector, by way of example as a result of their mating region pressing together.

On the one hand, this is of particular important because as a consequence a contact opening that is plugged over the mating region onto the printed circuit board connector may be held so as to be able to move on the connecting section at least within the desired tolerance range along the said pin axis, said contact opening being for example a through-going contact opening of a second printed circuit board.

On the other hand, this is of advantage because as a result of its at least slight elastic deformation the printed circuit board connector may press in this manner with a corresponding restoring force from inside against the contact material of the second through-going contact opening of the second printed circuit board and as a consequence is able to apply a corresponding high contact force so as to provide an electrical contact with a correspondingly high conductivity value.

In a preferred embodiment, the printed circuit board connector comprises in addition a second slit that likewise commences at the mating-side end and extends in the direction of the printed circuit board connection region and crosses the first slit in the said pin axis in particular at a right angle. This is particularly advantageous because as a consequence the elasticity of the printed circuit board connector is increased. Finally, as a consequence, this forms four in particular identical segments of the printed circuit board connector that may be deflected at least in a slightly elastic manner whilst applying a corresponding counterforce in particular uniformly for example in the direction of the pin axis.

It goes without saying that the printed circuit board connector may have in addition to the first and the second slit also one or multiple further slits, in other words it may have in total three, four, five, . . . , n such slits, wherein n represents any random natural number. These may create a corresponding number of segments. However, it is to be noted in this case that both the contact area of the printed circuit board connector and also the counterforce that it applies to counter the deformation reduces with the number and/or the width of the slits.

The aforementioned variants of two slits that cross at right angles in the pin axis have therefore shown to be particularly advantageous in practice. As a consequence, it is possible to form in the mating section and in the connecting section of the printed circuit board connector four identical segments that uniformly deform when subjected to a uniform loading.

In a further preferred embodiment, the slit ends/the slits end either in the connecting section or at the latest at the end of the connecting section. This is particularly advantageous because in this manner the printed circuit board connection region, which is provided for contacting a first printed circuit board, has a solid structure since it consequently does not have a slit. Finally, it may as a consequence be effectively soldered to the first printed circuit board.

So as to deform in the said elastic manner as it is inserted into a contact opening, for example the contact opening of a second printed circuit board, the printed circuit board connector is advantageously formed from an at least slightly reversibly deformable, electrically conductive material. In particular, the printed circuit board connector may be formed from metal which advantageously benefits these mechanical characteristics and in addition the electrical conductivity.

In one advantageous embodiment, the printed circuit board connector may be a turned part in its basic form. As a consequence, it is very stable and may be manufactured in an automated and thus cost-effective manner. In particular, the at least one slit may be provided in the pin contact with only a small outlay, for example by means of a sawing or milling process.

One system comprises at least a first printed circuit board and at least one printed circuit board connector as has previously been described. The first printed circuit board may comprise at least one through-going contact opening and at least one first electrical contact region that is arranged on the first through-going opening. In particular, the first contact region may also cover the inner face of the respective through-going opening.

In one advantageous embodiment, the at least one printed circuit board connector may comprise between its printed circuit board connection region and its connecting section a circumferential collar with which the printed circuit board connector is placed on the first printed circuit board. As a consequence, the printed circuit board is connected to the first printed circuit board in a mechanically particularly stable manner. Furthermore, the printed circuit board connector may be electrically contacted via its collar to the contact region of the through-going opening of the first printed circuit board, in particular soldered thereto, as a result of which the common contact surface and thus the current strength of the electrical current that may be transmitted thereby increases.

Furthermore, the at least one printed circuit board connector may be inserted on the mating side, in other words initially with its mating region, through a second through-going contact opening of a second printed circuit board and electrically contact this second printed circuit board at a second contact region that is arranged at the second through-going contact opening.

In so doing, the mating region of the at least one printed circuit board connector may be at least slightly elastically compressed as a result of an at least slight deformation of the connecting section whilst applying a corresponding counterforce and may press against the second contact region with the counterforce in order to contact said second contact region with a correspondingly high electrical conductivity value.

By virtue of the printed circuit board connector being able to deform at least slightly, the second printed circuit board is held with its at least one through-going contact opening against the printed circuit board connector in such a manner that said printed circuit board connector is able to move within a predetermined tolerance range in the direction of the first printed circuit board and/or in the opposite direction. This is particularly advantageous in order to compensate tolerances during the construction of the device. In fact, by virtue of this structural shape, the second printed circuit board may be moved toward the first printed circuit board and away from said first printed circuit board in the predetermined tolerance range even in the already assembled state. By virtue of its at least one slit and in particular its at least slightly reversibly deformable material, in particular metal, the printed circuit board connector is in fact able to at least slightly deform as required for this purpose.

BRIEF DESCRIPTION OF THE DRAWINGS

An exemplary embodiment of the invention is illustrated in the drawings and is explained in detail below.

DETAILED DESCRIPTION

Figure 1A:
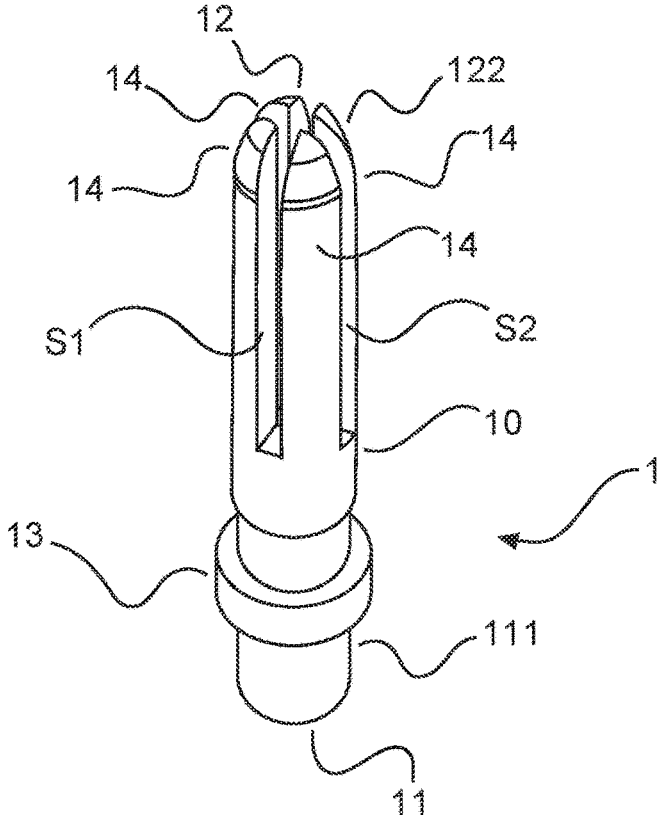
FIG. 1*a-b* illustrates a printed circuit board connector in various views.

The figures illustrate in part simplified schematic views. In part, identical reference numerals are used for similar but possibly not identical elements. Different views of similar elements may be scaled differently.

Figure 1B:
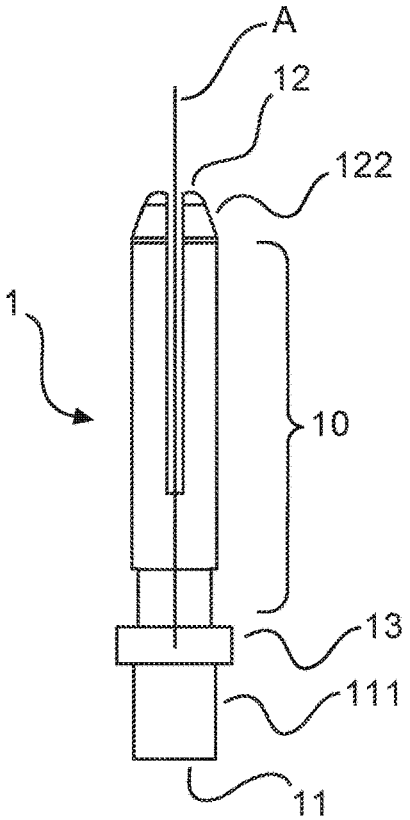

FIGS. 1*a-b* illustrate a printed circuit board connector 1.

The printed circuit board connector 1 is configured as a pin contact with a pin axis A indicated in FIG. 1*b* and is embodied from an at least slightly reversibly deformable, electrically conductive material. In the present case, the printed circuit board connector 1 is embodied from metal but it is also feasible to use another material by way of example an electrically conductive or conductively coated synthetic material.

The printed circuit board connector 1 comprises a connection-side end 11 and a mating-side end 12. It comprises a printed circuit board connection region 111 on its connection-side end 11. Lying opposite, it comprises a mating region 122 that tapers toward the mating-side end 12. The printed circuit board connector 1 comprises between the printed circuit board connection region 111 and the mating region 122 a pin-shaped connecting section 10 whose region is graphically emphasized in FIG. 1*b* with the aid of a curly bracket. The printed circuit board connector 1 comprises between the connecting section 10 and the printed circuit board connection region 111 a cylindrical, circumferential collar 13.

The printed circuit board connector 1 comprises two slits S1, S2, namely a first slit S1 and a second slit S2 that cross in the pin axis at a right angle and end in the connecting section 10, said slits commencing at the mating-side end 12 and extending in the direction of the printed circuit board connection region 111 along the pin axis A. As a consequence, four identical segments 14 that are particularly clearly visible in FIG. 1*a* are formed in the printed circuit board connector 1. Each of the four segments 14 comprises at the mating-side end 12 of the printed circuit board connector 1 a free-standing end that for the sake of clarity are not provided with separate reference numerals. The segments 14 face with their free-standing ends jointly in the mating direction of the printed circuit board connector 1.

Figure 1C:
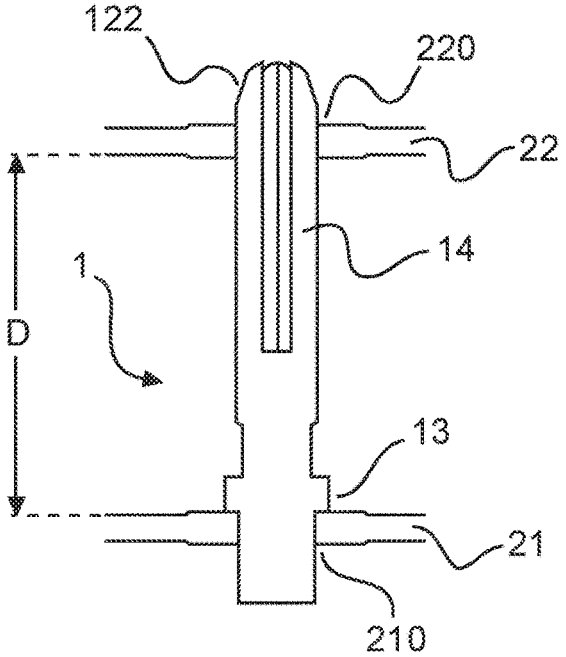
FIG. 1*c* illustrates a cross-sectional view of the printed circuit board connector with two printed circuit boards.

FIG. 1*c* illustrates a cross-sectional view of the printed circuit board connector 1 with two printed circuit boards 21, 22, namely a first printed circuit board 21 and a second printed circuit board 22, said printed circuit boards being connected by means of said printed circuit board connector. The two printed circuit boards 21, 22 have in each case multiple through-going contact openings 210, 220.

On the one hand, the printed circuit board connector 1 is inserted with its printed circuit board connection region 111 through one of the through-going contact openings 210 of the first printed circuit board 21 and soldered to the contact region 228 (shown in FIG. 2*c*) that is located thereon also on the inner face. Simultaneously, it is placed with its collar 13 on the second printed circuit board 22.

Furthermore, it is clearly apparent that on the other hand, so as to electrically connect the two printed circuit boards 21, 22, the printed circuit board connector 1 has been guided beforehand with its mating region 122 through the through-going contact opening 220 of the second printed circuit board 22 and now engages therethrough in an electrically contacting manner with a part of its connecting section 10, said part being adjacent to the mating region 122. In so doing, as the mating region 122 is inserted into the through-going contact opening 220 the respective free-standing ends of the four segments 14 are to move toward one another whilst the segments 14 deform in a slightly elastic manner. As a consequence, the segments 14 generate a corresponding counterforce with which they press against a contact material that is arranged in the through-going opening 220 and is a component of the contact region 228.

In this manner, a mechanical attachment arrangement and an electrical contacting arrangement is created between the two printed circuit boards 21, 22, wherein the electrical contacting arrangement prints a particularly high conductivity value as a result of the corresponding high contact force. The mechanical attachment arrangement has simultaneously the desired tolerance values.

By virtue of this deformation, in the plugged-in state the four segments 14 are oriented with their free-standing ends slightly toward one another. Consequently, in the plugged-in state the printed circuit board connector 1 tapers slightly toward its mating region 12. Conversely, in the plugged-in state it widens slightly in the direction of its printed circuit board connection region 111.

The second printed circuit board 22 may therefore be inserted within a predetermined tolerance range slightly deeper, but ideally not to any depth, onto the connecting region 10 of the printed circuit board connector 1. In the reverse direction, i.e. in the mating direction, the second printed circuit board 22 may also be moved away from it and/or completely pulled off it. In other words, the printed circuit board connector 1 may be inserted with its connecting region 10 still somewhat deeper into the through-going contact opening 220 of the second printed circuit board 22 or pulled back somewhat further out. As the printed circuit board connector 1 is inserted deeper in, the segments 14 move with their free-standing ends in a somewhat slightly more elastic manner with respect to one another. As the printed circuit board connector 1 is pulled out slightly, said segments move back in a somewhat more intense manner away from one another. As a consequence, a tolerance region is created within which the plug-in depth may vary. Consequently, a distance D between the two printed circuit boards 21, 22 may also vary within the thereby predetermined tolerance range while simultaneously the electrical contacting arrangement is ensured for high current strengths, for example >10 amps.

Figure 2A:
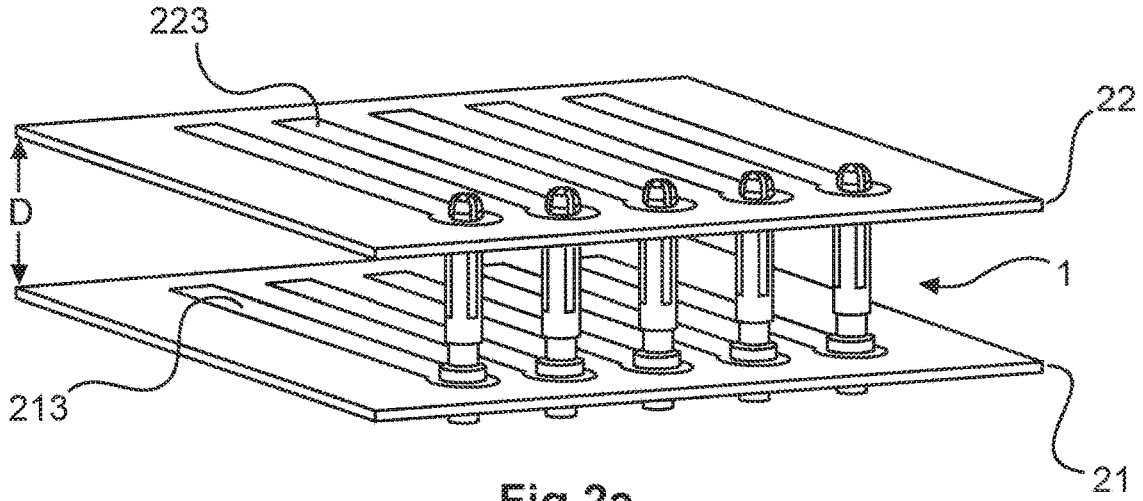
FIG. 2*a-b* illustrates an arrangement of the two printed circuit boards that are connected to one another via multiple printed circuit board connectors.
Figure 2B:
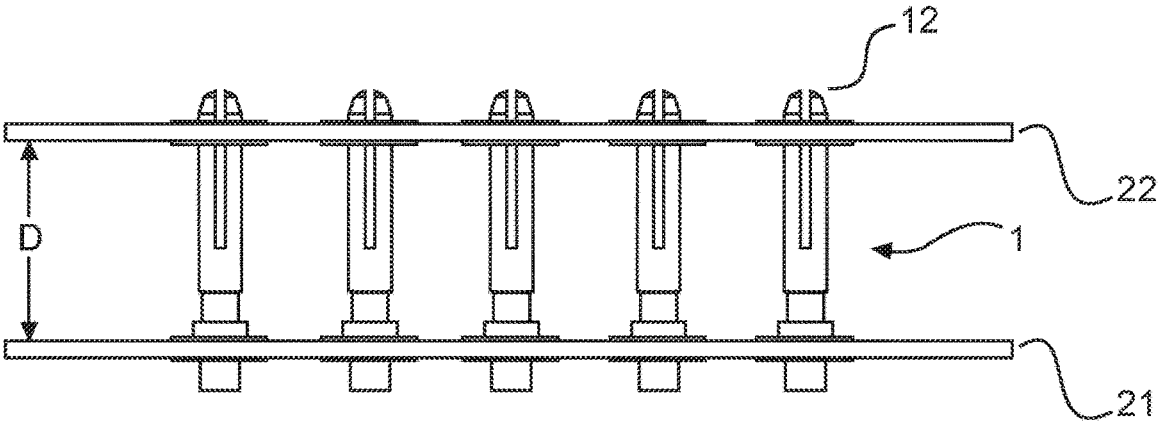

FIGS. 2*a* and 2*b* illustrate an oblique view and a lateral view of the two mutually parallel printed circuit boards 21, 22 with conductor tracks 213, 223 located thereon. The two printed circuit boards 21, 22 are mechanically and electrically connected to one another via multiple printed circuit board connectors 1, as explained above in detail with reference to the example of a printed circuit board connector 1. The electrical connection is thereby formed between two conductor tracks 213, 223 respectively.

Figure 2C:
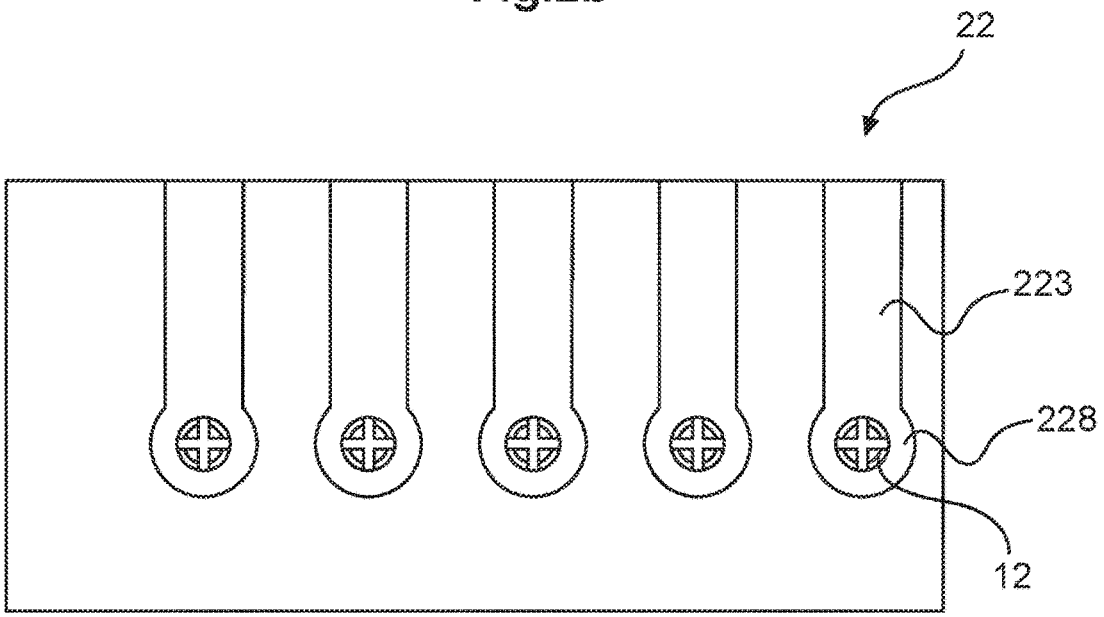
FIG. 2*c* illustrates a plan view of the arrangement from the preceding illustration.

FIG. 2*c* illustrates a plan view of this arrangement. It is clearly apparent how the printed circuit board connector 1 engages through the through-going contact opening 220 of the second printed circuit board 22 and protrudes with its mating-side end 12 out of the second printed circuit board 22, as a result of which it elastically contacts the corresponding conductor track 223 at the contact region 228 thereof.

Even if different aspects or features of the invention are illustrated in the figures in each case in combination, it is obvious to the person skilled in the art—unless otherwise indicated—that the illustrated and discussed combinations are not the only possible combinations. In particular, units or feature complexes of different exemplary embodiments that correspond to one another may be exchanged with one another.

LIST OF REFERENCE NUMERALS

1 Printed circuit board connector
10 Connecting section
11 Connection-side end
111 Printed circuit board connection region
12 Mating-side end
122 Mating region
13 Collar
14 Segments
21 First printed circuit board
210 First through-going contact opening
213 First conductor track
22 Second printed circuit board
220 Second through-going contact opening

223 Second conductor track
228 Second contact region
A Pin axis
D Distance between the printed circuit boards
S1, S2 First, second slit

The invention claimed is:

1. A printed circuit board connector (1) for transmitting high currents between two parallel printed circuit boards (21, 22) and for providing a mutual attachment between the two parallel printed circuit boards, comprising:

a pin contact with a pin axis (A), the pin contact being capable of transmitting an electric current of more than 10 amps;

a printed circuit board connection region (111) arranged at a connection-side end (11) of the pin contact;

a mating region (122) that tapers toward a mating-side end (12) of the pin contact opposite the connection-side end;

a connecting section (10) arranged between the printed circuit board connection region (111) and the mating region (122); and a first slit (S1) that commences at the mating-side end (12) and extends along the pin axis (A) towards the printed circuit board connection region (111), whereby two segments (14) of the pin contact are formed that face in a mating direction.

2. The printed circuit board connector (1) as claimed in claim 1, wherein the printed circuit board connector (1) is formed from an at least slightly reversibly deformable, electrically conductive material.

3. The printed circuit board connector (1) as claimed in claim 1, wherein the printed circuit board connector (1) is formed from metal.

4. The printed circuit board connector (1) as claimed in claim 1, wherein the printed circuit board connector (1) is a turned part.

5. The printed circuit board connector (1) as claimed in claim 1, wherein the first slit (S1) is provided in the printed circuit board connector (1) by a sawing or milling process.

6. The printed circuit board connector (1) as claimed in claim 1, wherein the printed circuit board connector (1) is formed at least in sections in a symmetrical manner, and wherein the pin axis (A) is at least in regions a symmetrical axis of the printed circuit board connector (1).

7. The printed circuit board connector (1) as claimed in claim 1, wherein the pin contact being capable of transmitting an electric current of more than 16 amps.

8. The printed circuit board connector (1) as claimed in claim 1, wherein the pin contact being capable of transmitting an electric current of more than 24 amps.

9. The printed circuit board connector (1) as claimed in claim 1, wherein the pin contact being capable of transmitting an electric current of more than 32 amps.

10. The printed circuit board connector (1) as claimed in claim 1, wherein the pin contact being capable of transmitting an electric current of more than 40 amps.

11. The printed circuit board connector (1) as claimed in claim 1, wherein the connecting section (10) has a cylindrical enveloping contour with a constant diameter along the entire slit.

12. The printed circuit board connector (1) as claimed in claim 1, wherein the two segments (14) are made of solid metal.

13. The printed circuit board connector (1) as claimed in claim 1, further comprising a second slit (S2) that commences at the mating-side end (12) and extends along the pin axis (A) towards the printed circuit board connection region (111), wherein the second slit (S2) crosses the first slit (S1) in the pin axis (A), whereby four segments (14) of the pin contact are formed that face in the mating direction.

14. The printed circuit board connector as claimed in claim 13, further comprising one or more further slits that commence at the mating-side end (12) and extend along the pin axis (A) towards the printed circuit board connection region (111), whereby further segments are formed in addition to the four segments (14).

15. The printed circuit board connector (1) as claimed in claim 13, wherein the first slit (S1) and the second slit (S2) cross at right angles in the pin axis (A).

16. The printed circuit board connector (1) as claimed in claim 13, wherein the first slit (S1) and the second slit (S2) end in the connecting section (10) and do not extend past an end of the connecting section (10).

17. A system, comprising:

at least a first printed circuit board (21); and at least one printed circuit board connector (22) as claimed in claim 1, wherein the at least one printed circuit board connector (1) protrudes with its printed circuit board connection region (111) through a first through-going opening (210) of the first printed circuit board (21) and is in electrical contact with the first printed circuit board (21) at a first contact region of the first printed circuit board (21) that is arranged at the first through-going opening (210).

18. The system as claimed in claim 17, wherein the at least one printed circuit board connector (1) comprises between its printed circuit board connection region (111) and its connecting section (10) a circumferential collar (13) with which the printed circuit board connector (1) is placed on the first printed circuit board (21).

19. The system as claimed in claim 17, wherein the at least one printed circuit board connector (1) is inserted with its mating region (12) through a second through-going contact opening (220) of a second printed circuit board (22) and electrically contacts this second printed circuit board at a second contact region (228) that is arranged at the second through-going contact opening.

20. The system as claimed in claim 19, wherein the at least one printed circuit board connector (1) is at least in regions slightly elastically compressed as a result of an at least slight deformation of the segments (14) whilst applying a corresponding counterforce and presses against the second through-going contact opening (220) with the corresponding counterforce from inside in order to put the second through-going contact opening in electrical contact with the contact region (228) arranged there with a correspondingly high electrical conductivity value.

21. The system as claimed in claim 20, wherein, by virtue of the at least one printed circuit board connector (1) being able to at least slightly deform, the second printed circuit board (22) is held with its at least one through-going contact opening (220) against the printed circuit board connector (1) in such a manner that the printed circuit board connector is able to move within a predetermined tolerance range in the direction of the first printed circuit board (21) and/or in the opposite direction.

22. The system as claimed in claim 21, wherein by virtue of its first slit (S1) the at least one printed circuit board connector (1) is able to deform as said at least slightly.

* * * * *